US005217148A

United States Patent [19]

Cater

[11] Patent Number: 5,217,148

[45] Date of Patent: Jun. 8, 1993

[54] PHARMACEUTICAL PUMP DISPENSER

[75] Inventor: Miro S. Cater, Newtown, Conn.

[73] Assignee: Sprühventile GmbH, Wyhlam Kaiserstuhl, Fed. Rep. of Germany

[21] Appl. No.: 760,942

[22] Filed: Sep. 17, 1991

Related U.S. Application Data

[63] Continuation-in-part of Ser. No. 653,048, Feb. 11, 1991, Pat. No. 5,147,073.

[51] Int. Cl.[5] ..... B65D 88/54

[52] U.S. Cl. ..... 222/321; 222/385; 222/378

[58] Field of Search ..... 222/255, 215, 321, 370-372, 222/383-387, 378, 402.22, 400.5; 417/510

[56] References Cited

U.S. PATENT DOCUMENTS

| | | | |
|---|---|---|---|
| 3,531,224 | 9/1970 | Clevenger et al. | 222/321 X |
| 3,907,174 | 9/1975 | Steiman | 222/321 |
| 4,169,546 | 10/1979 | Yuhas et al. | 222/385 X |
| 4,228,931 | 10/1980 | Ruscitti et al. | 222/321 |
| 4,434,916 | 3/1984 | Ruscitti et al. | 222/321 |
| 4,826,031 | 5/1989 | Ruscitti | 222/321 X |
| 4,911,336 | 3/1990 | Blake | 222/321 |
| 4,960,230 | 10/1990 | Marelli | 222/321 |
| 5,038,965 | 8/1991 | Cater | 222/321 X |

*Primary Examiner*—Andres Kashnikow

*Assistant Examiner*—Kenneth DeRosa

[57] ABSTRACT

A lower end of a first hollow cylinder is connected to an upper end of a second hollow cylinder. A first outer hollow stem has an intermediately disposed first external enlargement disposed within the first cylinder. A hollow vertical main piston is vertically slidable within the first cylinder. A second inner stem extends upwardly through the main piston and through a bore in the first stem. A space between an upper section of the second stem and the first stem defines a vertical fluid discharge path. An upper end of an integral lower vertical section of the second stem engages the lower end of the main piston so that a horizontal channel extends between the lower section and the lower end of the main piston and connects the region between the lower section and the inner wall of the first cylinder to the fluid discharge path. A fluid discharge port is formed between the upper ends of the first section and the inner stem. A vertical inner piston has an upper end engagable with the lower end of the lower section and is vertically slidable in the second cylinder. A second outwardly extending enlargement of the second cylinder engages the inner wall of the second cylinder. An arrangement normally biases the discharge port closed and opens the discharge port during a selected point on the downstroke.

8 Claims, 4 Drawing Sheets

PHARMACEUTICAL PUMP DISPENSER

CROSS REFERENCE TO COPENDING APPLICATION

This application is a continuation-in-part of copending application Ser. No. 07/653,048, filed Feb. 11, 1991, now U.S. Pat. No. 5,147,073, and owned by the assignee of the present application. The contents of this copending application is incorporated by reference into the present application.

BACKGROUND OF THE INVENTION

U.S. Pat. No. 5,038,965 discloses a finger actuated pump dispenser for pharmaceutical applications which not only discharges fluid at a predetermined pressure but also delivers a predetermined dosage regardless of the method of actuation employed. However, when the dispenser is actuated after it has been stored unused for some period, fluid will have evaporated from the volume within the actuator and the fluid pathway between the chamber seal and the finger controlled actuator. Consequently, the dose delivered to the user by the first actuation will be somewhat less than delivered by subsequent actuations. In some pharmaceutical applications, it is essential for the dispenser to deliver an accurate dose upon such first actuation.

Copending application Ser. No. 07/653,048 is directed toward a pump dispenser which eliminates this evaporation of fluid from the volume within the fluid pathway between the chamber by moving the exit chamber seal to the top of the pump. However, in this application, the inner stem and the main piston never move relative to each other. The seal is initially closed with maximum engagement of the areas of the parts forming the seal. During actuation of the dispenser, the pressure buildup within the pump chamber causes the stem and piston to move upward together relative to the outer stem and the seal is eventually opened. The areas of engagement of the parts forming the seal are gradually reduced as the actuation progresses prior to opening of the seal. Consequently, the parts forming the seal must be manufactured to very close tolerances to prevent leaking as the areas of engagement are decreased.

The present invention is directed toward a pump dispenser having a top disposed exit chamber seal and which is constructed in such manner that wider tolerances in manufacture can be tolerated, while at the same time, the top seal will not leak during actuation.

SUMMARY OF THE INVENTION

In accordance with the principles of this invention, a finger actuated fluid pump dispenser is mounted on a fluid containing vessel.

The dispenser employs a vertical hollow elongated body with an upper section defining a first hollow vertical cylinder having an open upper end and having a first diameter. The body also has an integral lower section defining a second hollow vertical cylinder having a closed lower end with a central opening and having a second and smaller diameter. The lower end of the first cylinder is connected to the upper end of the second cylinder. A cap having a central opening encloses the upper end of the first cylinder.

A first outer hollow stem open at upper and lower ends and interconnected by a vertical bore has a first external enlargement intermediate these ends. A portion of the first stem intermediate the upper end and the first enlargement extends upwardly through the cap opening. The first enlargement is disposed below the cap, and, together with the remaining portion of the first stem, is disposed within the first cylinder.

A hollow vertical main piston has an upper open end and a lower closed end with a central opening and is disposed and is vertically slidable within the first cylinder. The inner surface of the closed end has an inwardly extending bead.

A second inner stem has an upper vertical section with relatively small cross sectional area which extends upwardly through the main piston and through the bore in the first stem. The upper section is spaced inwardly from this bore, the space between the upper section and the outer stem defining a vertical fluid discharge path. The inner stem has an integral lower vertical section with larger cross sectional area. The upper section in a region adjacent but spaced from the upper end of the lower section has a recess in which the bead of the main piston is disposed. The vertical depth of the bead is smaller than the vertical depth of the recess so that the main piston can be moved vertically up or down with respect to the second stem although the main piston and upper section of the inner stem always remain engaged. More particularly, the bead can engage the upper or the lower surface of the recess or can be disposed between and spaced from both upper and lower surface recesses.

The cross sectional area of the lower section is smaller than that of the second cylinder. The lower section has an upper end which engages the lower end of the main piston in such manner that at least one horizontal channel extends between the lower section and the lower end of the main piston and, at least during downstrokes, connects the region between the lower section and the inner wall of the first cylinder to the fluid discharge path. The channel can be otherwise sealed or can remain open.

Port means cooperating with the upper end of the first stem and the upper end of the upper section of the second stem defines a fluid discharge port which has an open position for allowing fluid discharge therethrough and a closed position for blocking fluid discharge therethrough. The port means is open when the bead of the main piston engages the upper surface of the recess in the second stem and is closed while the bead is otherwise disposed in the recess.

A vertical inner piston has an upper end which is adjacent and engagable with the lower end of the lower section. The second piston is vertically slidable in the second cylinder and has a second outwardly extending enlargement which engages the inner wall of the second cylinder.

First biasing means is disposed in the first cylinder within the first piston between the lower end of the first piston and the first enlargement. The first biasing means normally biases the first stem toward the lower section of the second stem.

Second biasing means is disposed in the second cylinder between the lower end of the body and the enlarged portion of the second piston. An actuator is secured to the upper end of the sleeve and first stem adjacent the port means.

Means associated with the second piston and the second cylinder and actuated during at a selected position of the second piston with respect to the second cylinder during an upstroke establishes a fluid transfer path between the fluid in the container and the pump chamber formed by the space subtended by the inner wall of the first cylinder, the second stem and the two pistons.

Initially during the downstroke, the bead of the main piston engages the lower surface of the recess and the discharge port is firmly sealed and cannot leak. At a selected point during the downstroke, the biasing action of the first resilient means is overcome by the pressure within the pump chamber, the bead of the main piston moves upwardly away from the lower surface in the recess. The second stem remains engaged with the first stem until the bead reaches the upper surface in the recess. Once the bead reaches this upper surface, the two stems separate with the second stem being rigid with the main piston and the discharge port is opened. This selected point can be varied as desired by suitably adjusting the relative dimensions of the main piston bead and the inner stem recess.

As the downstroke is completed, the bead is moved downward in the recess until it engages the lower surface of the recess. The discharge port is closed firmly and rapidly with no leakage when this engagement occurs.

When the adjacent sealing surfaces of the discharge port are constructed to be flat and horizontal, leakage will not occur. However, when these surfaces are not flat and horizontal, but instead are inclined, these surfaces can be constructed more easily while maintaining a leakage free seal.

DETAILED DESCRIPTION OF PREFERRED EMBODIMENTS

Figure 1:
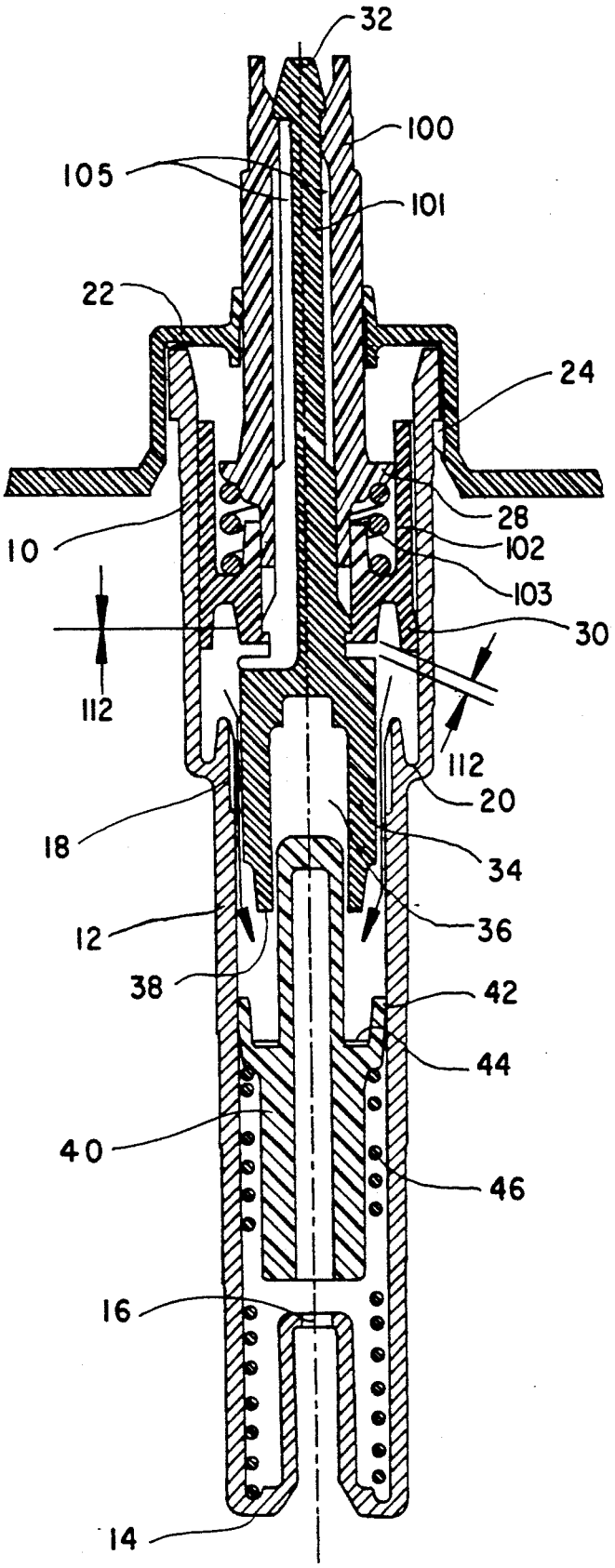
FIG. 1 is a cross sectional view of a preferred embodiment of the invention showing the bead of the main piston engaging the upper surface of the second stem with the discharge port closed.
Figure 2:
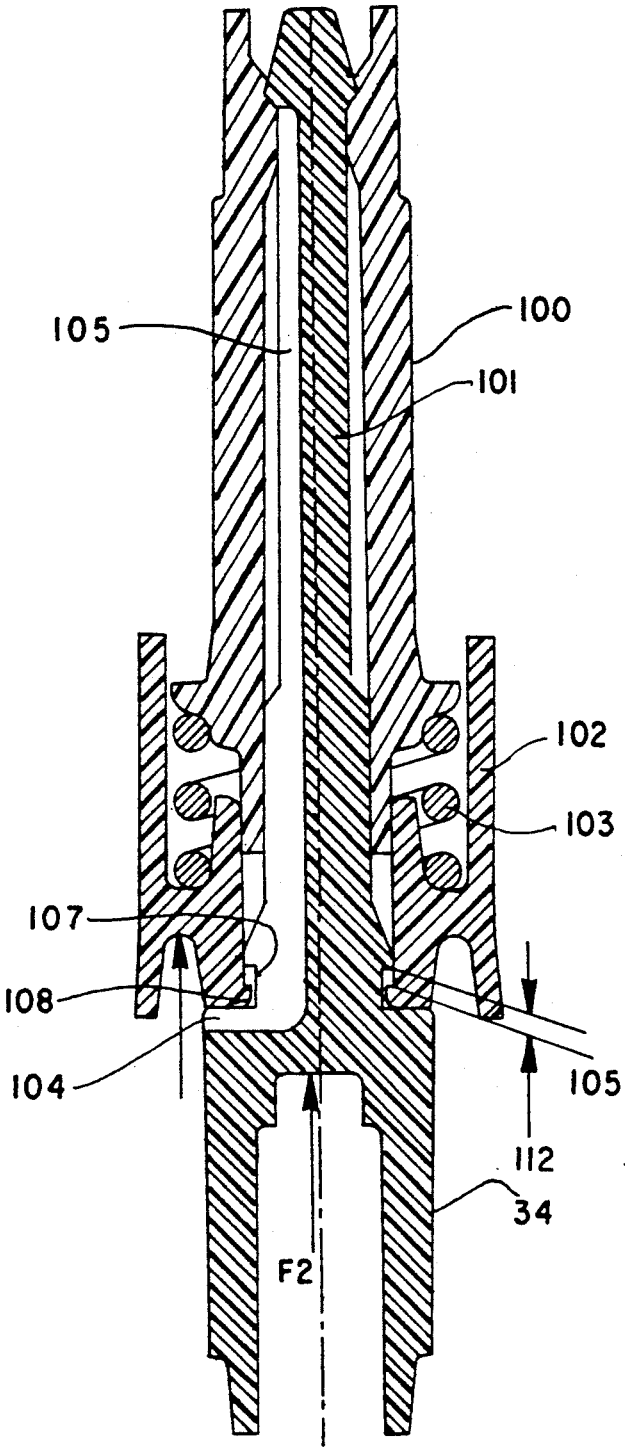
FIG. 2 is a detail vertical cross sectional view of the preferred embodiment showing the bead of the main piston engaging the lower surface of the second stem with the discharge port closed
Figure 2A:
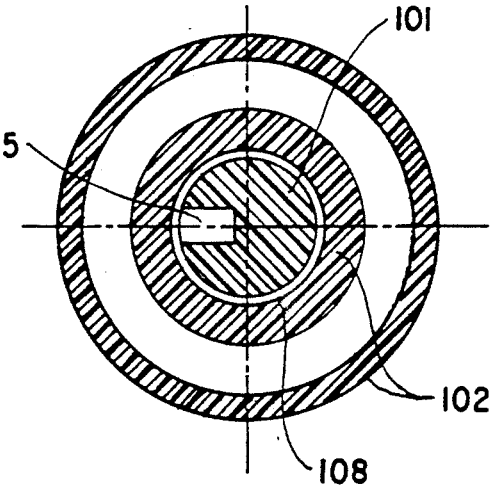
FIG. 2A is a cross sectional view through line 2A in FIG. 2.
Figure 3:
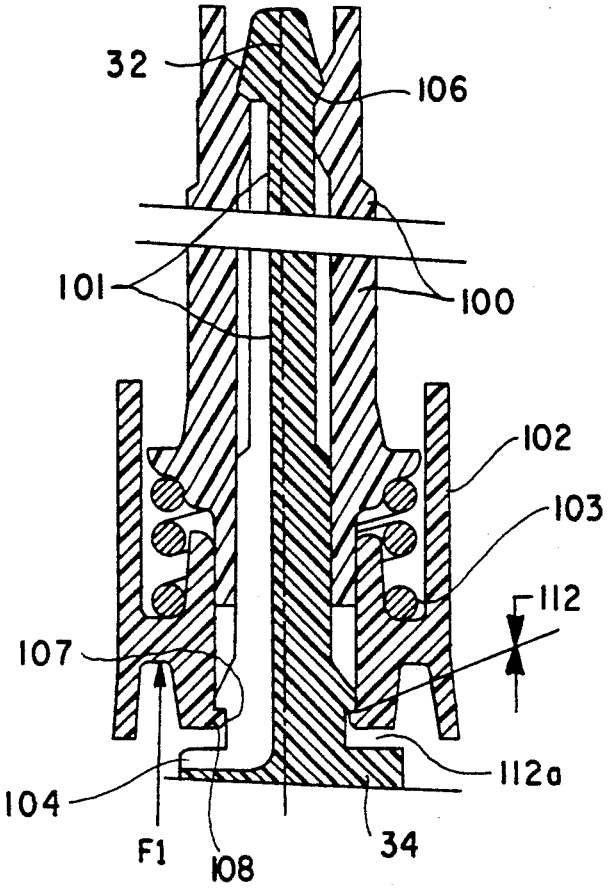
FIG. 3 is a detail vertical cross sectional view of the preferred embodiment showing the bead of the main piston approaching engagement with the upper surface of the second stem with the discharge port still closed.
Figure 4:
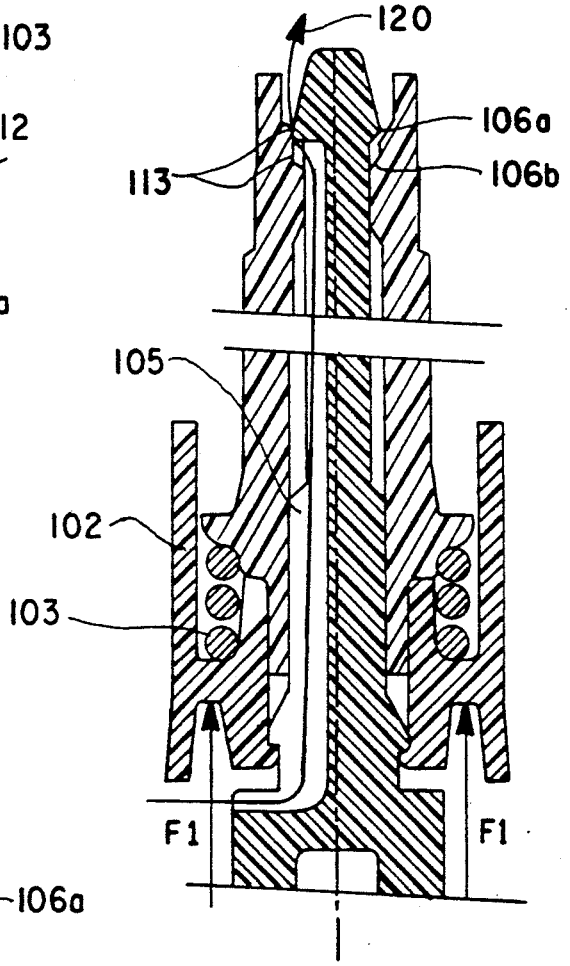
FIG. 4 is a view similar to FIG. 3 but showing the discharge port in open position.
Figure 4A:
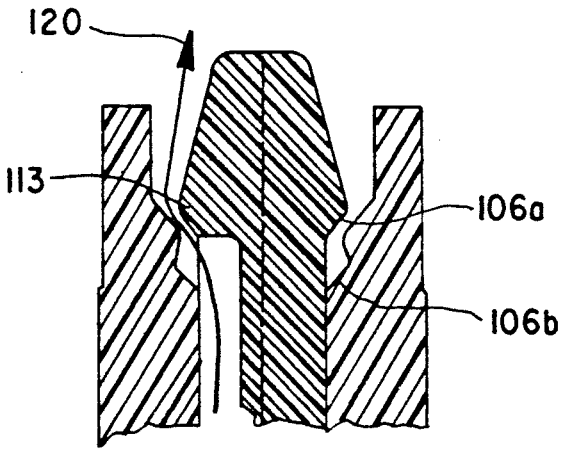
FIG. 4A is an enlarged detail view of the open discharge port shown in FIG. 4.

Referring now to FIGS. 1–4, a hollow body has an upper hollow cylinder 10 having a first diameter and an open upper end. The body has an integral lower hollow cylinder 12 having a second and smaller diameter with a lower end 14 having a central opening 16 which is raised above the remainer of this lower end. [If desired, opening 16 can be lowered below the remainder of this lower end.] The body has a vertical bore which extends completely through the body. Cylinder 12 has an open upper end with a plurality of inner recesses 18 in its inner wall which are spaced outwardly from the remainder of the inner wall. The upper end of cylinder 12 is integral with the lower end of cylinder 10 but the outer periphery of the lower end of cylinder 10 is spaced away from the outer periphery of the upper end of cylinder 12 by a horizontal circular groove or recess 20.

A cap 22 snaps over the upper end of cylinder 10 and has a central opening aligned with the vertical bore in the body. The cap is spaced from the upper end of cylinder 10 by one or more slots 24 which form air passages. The cap with the body attached is fitted to the neck of a container of fluid. A vertical dip tube can be fitted into the lower end 14 with its upper opening engaging opening 16.

A vertical outer stem 100 open at both ends has an outwardly extending enlargement 28 disposed intermediate its ends. The upper portion of stem 100 above enlargement 28 extends upwardly through the opening of cup 22 with the enlargement 28 and the remainder of the stem 101 disposed in the first cylinder.

A hollow vertical main piston 102 has an open upper end and a lower end which is closed except for a central opening aligned with the cylinder bore. The bottom of the lower end has an inwardly extending horizontal bead 108. Piston 102 is vertically slidable within cylinder 10. The outer portion of the closed end defines a ring 30 which is engagable with groove 20 to limit the downward travel of piston 102.

An inner stem has a solid upper vertical section 101 of relatively small cross sectional area spaced inwardly from and extending upwardly through the piston 102 and the outer stem 100 Section 101 has vertical channels 105 defining a vertical fluid discharge path or channel.

Section 101 has at its upper end an enlarged head 32 with outer inclined contours 106A. The upper end of outer stem 100 has conforming inner inclined contours 106B adapted to receive the contours 106A of head 32 is sealing relationship. This arrangement of mating contours constitutes a discharge port. When the contours are in mating relationship, the port is closed.

The inner stem has a lower section 34 of larger cross sectional area than its upper portion 101. The top surface of lower section 34 has horizontal grooves 104, each of which is connected to a corresponding vertical channel 105. The main piston engages the top surface but is spaced above the grooves 104.

The upper section 101 adjacent but above section 34 has an inwardly extending horizontal recess 107 which is always engaged by bead 108. The bead can engage the upper surface of the recess or the lower surface of the recess or be in any position therebetween. Section 34 has a lower open end with a vertically elongated cavity 36 with a downwardly extending ring 38.

A hollow vertical inner piston 40 is vertically slidable in the second cylinder. Piston 40 has an outwardly and upwardly extending enlargement 42 which engages and seals to the inner wall of the second cylinder at all times except when enlargement 42 is aligned with recess 18 at the upper end of cylinder 12. When this alignment takes place, fluid can pass therebetween.

The upper end of piston 40 is closed and the upper portion of piston 40 above the enlargement is engagable with the vertical recess 36. Enlargement 42 has a horizontal circular groove 44 which is engaged by ring 38 when the upper portion of piston 40 engages recess 36.

First biasing means in the form of compression spring 103 is disposed within cylinder 10 with its upper end bearing against enlargement 28 and its lower end bearing against the lower end of piston 102. Second biasing means in the form of compression spring 46 is disposed within cylinder 12 with its upper end bearing against enlargement 42 and its lower end bearing against the lower end of cylinder 12.

When this embodiment is at rest, the portion of the cylinder 10 which is subtended by the inner wall of this cylinder, the inner stem and the two pistons defines a pump chamber and is filled with fluid. The enlargement 42 is aligned with recess 18.

The pressure which is created within the pump chamber when the dispenser is actuated exerts an upward force F1 upon piston 102 and an upward force F2 acting upon the inner stem 101. These forces are opposed by the downwardly acting bias of spring 103. Since the inner and outer stems cannot move relative to each other because of interlocks 113, the discharge port is sealed. The upward movement of the piston 102 compresses the spring 103, eventually reducing the gap 112 to zero. The piston and stem 101 then move upward together, opening the port and forming fluid discharge path 120.

As the fluid is discharged from the pump chamber, the pressure therein is reduced, and the spring 103 carries the piston 102 downward and the gap 112 begins to enlarge. When the gap is restored to its original position, the piston and the inner stem travel downward together relative to the outer stem and the discharge port is closed.

The size of gap 112 is chosen in conjunction with the gradient of both springs to open the discharge port at the desired point in the stroke or at any desired pressure.

Once the discharge port 104 is opened, the fluid in the lower cylinder is discharged upwardly through the upper cylinder as piston 34 begins to travel upward under the force of spring 46 and expels the fluid 34. The pistons, the outer stem, springs, and the lower section move upward as a unit. When the second enlargement 42 becomes aligned with recess 18, a fluid conduction path is established between the fluid in the container, via a dip tube and the space between the enlargement and the inner wall in the second cylinder, and suction force pulls the fluid upward into the first cylinder thus filling the pump chamber.

Figure 5:
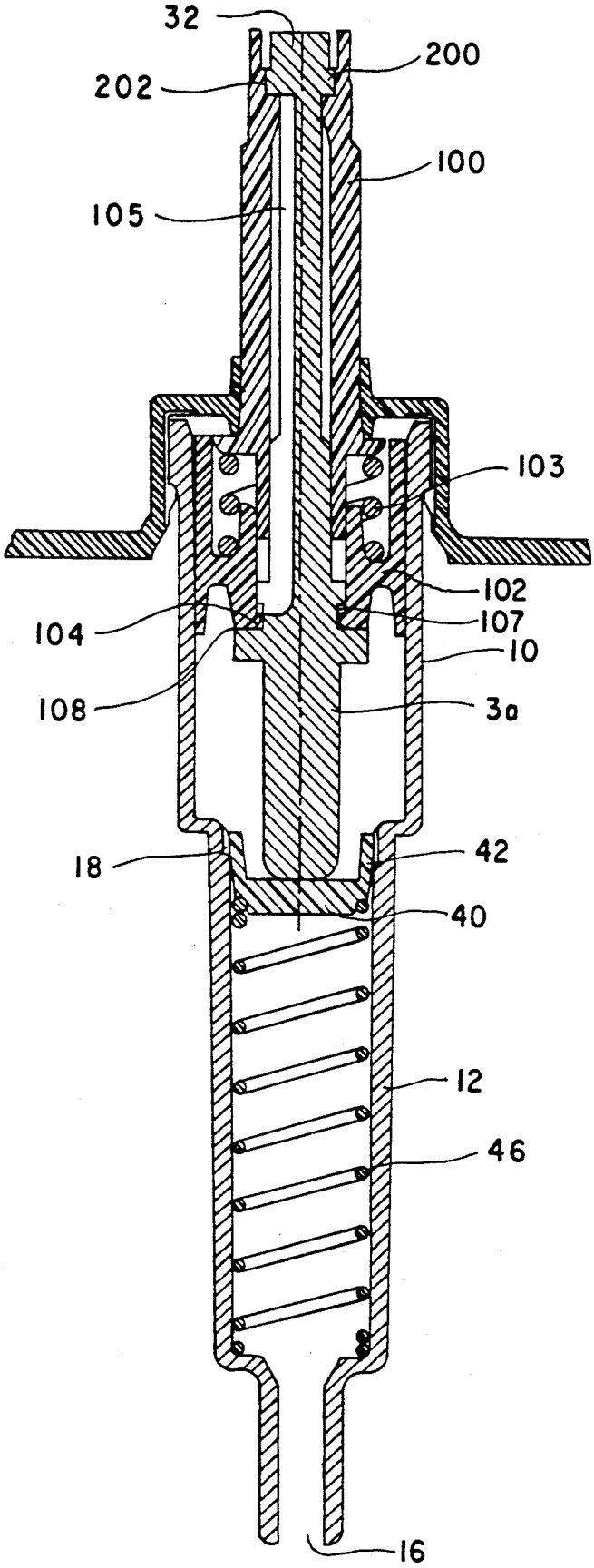
FIG. 5 is a view similar to FIG. 1 but illustrating a modification thereof.

In the embodiment shown in FIG. 5, the contours 106A and 106B are replaced by mating flat surfaces 200 of the head 32 and 202 of the upper section 100. Section 34 has a closed lower end which can engage the lower piston 40 as shown. In the embodiment of FIGS. 1–4, horizontal grooves 104 are always connected to vertical channel 105. In the embodiment of FIG. 5, horizontal grooves 104 are connected to channel 105 when the port is open, but section 34 breaks this connection when the port is closed, thus providing an additional seal.

What is claimed is:

1. A finger actuated pump dispenser mounted on a fluid containing vessel and comprising:

a vertical hollow elongated body having an upper section defining a first hollow vertical cylinder with a first diameter and an open upper end and an integral lower section defining a second hollow vertical cylinder with a second diameter smaller than the first diameter and a closed lower end with a central opening, the first cylinder having a lower end which is joined to an open upper end of the second cylinder;

an outer hollow stem open at upper and lower ends with a vertical bore therebetween, the outer stem having a first outwardly extending enlargement intermediate these ends, a portion of the first stem intermediate the upper end and the first enlargement extending upwardly through the upper end of the first cylinder with the first enlargement and a remaining portion of the first stem being disposed within the first cylinder;

a hollow vertical main piston having an upper open end, the main piston having a lower closed end with a central opening and an inwardly extending horizontal bead, the main piston being disposed and vertically slidable along the outside of the first stem within the first cylinder;

an inner stem having an upper vertical section and an integral lower section, the lower section having a cross sectional area which is larger than the cross sectional area of the upper section of the inner stem and is smaller than the cross sectional area of the second cylinder, the upper section of the inner stem extending upwardly through the first piston and through the bore and being spaced inwardly from the inner surface of the outer stem, thus defining a vertical fluid discharge path therebetween, the upper end of the lower section of the inner stem engaging the lower end of the main piston in such manner that, during downstrokes, at least one horizontal channel is disposed between the upper end of the lower section of the inner stem and the lower end of the main piston and connects the region between the inner wall of the first cylinder and the lower section of the inner stem with the fluid discharge path, the upper section of the inner stem adjacent but above the lower section of the inner stem having an inner horizontal recess engaged by said bead, the depth of the bead being smaller than the depth of the recess;

port means cooperating with the upper ends of the outer stem and the upper section to define a fluid discharge port which has an open position for allowing fluid discharge therethrough and a closed position for blocking fluid discharge therethrough;

a vertical inner piston vertically slidable in the second cylinder with an upper end adjacent and engagable with the lower end of the lower section of the second cylinder, the inner piston having a second outer enlargement which engages the inner wall of the second cylinder;

first biasing means disposed within the first cylinder between the lower end of the main piston and the first enlargement, the first biasing means causing the port means to close the discharge port except during a downstroke, the port being opened at a selected point during said downstroke;

second biasing means disposed within the second cylinder between the lower end of the second cylinder and the second enlargement; and means associated with the inner piston and the second cylinder which when actuated during an upstroke following said downstroke establishes a fluid transfer path between the fluid in the container and a pump chamber formed by the space subtended by the inner wall of the first cylinder, the inner stem and the two pistons when the inner piston attains a selected position with respect to the second cylinder.

2. The dispenser of claim 1 wherein the recess has upper and lower surfaces, the port means being open when the bead engages the upper surface of the recess and being otherwise closed.

3. The dispenser of claim 2 wherein the first and second biasing means are spring means.

4. The dispenser of claim 2 wherein the one horizontal channel disposed between the upper end of the lower section of the inner stem and the lower end of the main piston always connects the region between the inner wall of the first cylinder and the lower section of the inner stem with the fluid discharge path.

5. The dispenser of claim 2 wherein the upper ends of the outer stem and the upper section of the inner stem have conforming contours which can be moved into and out of mating engagement, the port means being closed when the contours are in mating engagement and being open when the contours are out of mating engagement.

6. The dispenser of claim 2 wherein the upper ends of the outer stem and the upper section of the inner stem have flat surfaces which can be moved into and out of mating engagement, the port means being closed when these surfaces are in mating engagement and being open when these surfaces are out of mating engagement.

7. The dispenser of claim 2 wherein the means associated with the inner piston and inner cylinder includes an enlarged recess disposed in the inner wall of the second cylinder at its upper end, said fluid transfer path being established when the second enlargement is aligned with and spaced from said recess of said means for establishing said fluid path.

8. A finger actuated pump dispenser mounted on a fluid containing vessel and comprising:

a vertical hollow elongated body having an upper section defining a first hollow vertical cylinder with a first diameter and an open upper end and an integral lower section defining a second hollow vertical cylinder with a second diameter smaller than the first diameter and a closed lower end with a central opening, the first cylinder having a lower end which is joined to an open upper end of the second cylinder;

an outer hollow stem open at upper and lower ends with a vertical bore therebetween, the outer stem having a first outwardly extending enlargement intermediate these ends, a portion of the first stem intermediate the upper end and the first enlargement extending upwardly through the upper end of the first cylinder with the first enlargement and a remaining portion of the first stem being disposed within the first cylinder;

a hollow vertical main piston having an upper open end, the main piston having a lower closed end with a central opening and an inwardly extending horizontal bead, the main piston being disposed and vertically slidable along the outside of the first stem within the first cylinder;

an inner stem having an upper vertical section and an integral lower section, the lower section having a cross sectional area which is larger than the cross sectional area of the upper section of the inner stem and is smaller than the cross sectional area of the second cylinder, the upper section of the inner stem extending upwardly through the first piston and through the bore and being spaced inwardly from the inner surface of the outer stem, thus defining a vertical fluid discharge path therebetween, the upper end of the lower section of the inner stem engaging the lower end of the main piston in such manner that, during downstrokes, at least one horizontal channel is disposed between the upper end of the lower section of the inner stem and the lower end of the main piston and connects the region between the inner wall of the first cylinder and the lower section of the inner stem with the fluid discharge path, the upper section of the inner stem adjacent but above the lower section of the inner stem having an inner horizontal recess engaged by said bead, the depth of the bead being smaller than the depth of the recess, the recess having upper and lower surfaces;

port means cooperating with the upper ends of the outer stem and the upper section to define a fluid discharge port which has an open position for allowing fluid discharge therethrough and a closed position for blocking fluid discharge therethrough, the port means being open when the bead engages the upper surface of the recess, the upper ends of the outer stem and the upper section of the inner stem having conforming contours which can be moved into and out of mating engagement, the port means being closed when the contours are in mating engagement and being open when the contours are out of mating engagement;

a vertical inner piston vertically slidable in the second cylinder with an upper end adjacent and engagable with the lower end of the lower section of the second cylinder, the inner piston having a second outer enlargement which engages the inner wall of the second cylinder;

a first spring disposed within the first cylinder between the lower end of the main piston and the first enlargement, the first spring causing the port means to close the discharge port except during a downstroke, the port being opened at a selected point during said downstroke;

a second spring disposed within the second cylinder between the lower end of the second cylinder and the second enlargement; and means associated with the inner piston and the second cylinder which when actuated during an upstroke following said downstroke establishes a fluid transfer path between the fluid in the container and a pump chamber formed by the space subtended by the inner wall of the first cylinder, the inner stem and the two pistons when the inner piston attains a selected position with respect to the second cylinder.

* * * * *